US008362348B2

(12) United States Patent
Yamauchi

(10) Patent No.: US 8,362,348 B2
(45) Date of Patent: Jan. 29, 2013

(54) ELECTRONIC MUSICAL APPARATUS FOR GENERATING A HARMONY NOTE

(75) Inventor: Akira Yamauchi, Hamamatsu (JP)

(73) Assignee: Yamaha Corporation (JP)

( * ) Notice: Subject to any disclaimer, the term of this patent is extended or adjusted under 35 U.S.C. 154(b) by 81 days.

(21) Appl. No.: 13/107,376

(22) Filed: May 13, 2011

(65) Prior Publication Data

US 2011/0277617 A1 Nov. 17, 2011

(30) Foreign Application Priority Data

May 14, 2010 (JP) ..... 2010-111884

(51) Int. Cl.
*A63H 5/00* (2006.01)
*G04B 13/00* (2006.01)

(52) U.S. Cl. ..... 84/609; 84/613; 84/615; 84/616; 84/649; 84/653; 84/654

(58) Field of Classification Search ..... None
See application file for complete search history.

(56) References Cited

U.S. PATENT DOCUMENTS

| | | | | |
|---|---|---|---|---|
| 4,771,671 | A | 9/1988 | Hoff | |
| 5,003,860 | A | 4/1991 | Minamitaka | |
| 5,418,325 | A | 5/1995 | Aoki et al. | |
| 5,446,238 | A | 8/1995 | Koyama et al. | |
| RE37,041 | E | 2/2001 | Koyama et al. | |
| 6,831,219 | B1 * | 12/2004 | Bonham | 84/483.2 |
| 2001/0045154 | A1 * | 11/2001 | Aoki | 84/609 |
| 2008/0000345 | A1 * | 1/2008 | Hasegawa et al. | 84/613 |
| 2008/0028919 | A1 * | 2/2008 | Ueki et al. | 84/613 |
| 2011/0277617 | A1 * | 11/2011 | Yamauchi | 84/615 |
| 2012/0137855 | A1 * | 6/2012 | Gannon | 84/613 |

FOREIGN PATENT DOCUMENTS

| | | | |
|---|---|---|---|
| EP | 0031598 | A2 | 7/1981 |
| EP | 1065651 | A1 | 1/2001 |
| JP | 5-224677 | A | 9/1993 |
| JP | 2879948 | B2 | 4/1994 |

OTHER PUBLICATIONS

Extended European Search Report issued in corresponding European Patent Application No. 1 0656 51 A1 dated Sep. 30, 2011.

* cited by examiner

*Primary Examiner* — Marlon Fletcher
(74) *Attorney, Agent, or Firm* — Rossi, Kimms & McDowell LLP

(57) ABSTRACT

Tone pitch information is extracted from the received input note information. A scale is determined on the basis of retrieved tonality information. A reference scale note is determined on the basis of the extracted tone pitch information and the determined scale. A tone pitch of a harmony note is determined by counting scale notes which form the determined scale from the determined reference scale note until reaching a scale note designated by the retrieved degree information.

22 Claims, 5 Drawing Sheets

FIG.2

(a)

major scale

| interval | major second | major second | minor second | major second | major second | major second | minor second | |
|---|---|---|---|---|---|---|---|---|
| scale note | I tonic | II | III | IV sub-dominant | V dominant | VI | VII leading note | I tonic |
| number of semitones (ascending) | 0 | +2 | +4 | +5 | +7 | +9 | +11 | +12 |
| number of semitones (descending) | −12 | −10 | −8 | −7 | −5 | −3 | −1 | 0 |
| case of tonic C | C | D | E | F | G | A | B | C |

(b)

natural minor scale

| interval | major second | minor second | major second | major second | minor second | major second | major second | |
|---|---|---|---|---|---|---|---|---|
| scale note | I tonic | II | III | IV sub-dominant | V dominant | VI | VII leading note | I tonic |
| number of semitones (ascending) | 0 | +2 | +3 | +5 | +7 | +8 | +10 | +12 |
| number of semitones (descending) | −12 | −10 | −9 | −7 | −5 | −4 | −2 | 0 |
| case of tonic C | C | D | E♭ | F | G | A♭ | B♭ | C |

(c)

harmonic minor scale

| interval | major second | minor second | major second | major second | minor second | augmented second | minor second | |
|---|---|---|---|---|---|---|---|---|
| scale note | I tonic | II | III | IV sub-dominant | V dominant | VI | VII leading note | I tonic |
| number of semitones (ascending) | 0 | +2 | +3 | +5 | +7 | +8 | +11 | +12 |
| number of semitones (descending) | −12 | −10 | −9 | −7 | −5 | −4 | −1 | 0 |
| case of tonic C | C | D | E♭ | F | G | A♭ | B | C |

ELECTRONIC MUSICAL APPARATUS FOR GENERATING A HARMONY NOTE

BACKGROUND OF THE INVENTION

1. Field of the Invention

The present invention relates to an electronic musical apparatus which generates a harmony note in accordance with an input note.

2. Description of the Related Art

There are conventional electronic musical apparatuses which generate a harmony note in accordance with an input note. Such conventional apparatuses include a voice processing apparatus which converts input voice into harmony voice of a tone pitch which is consonant with input chord information (see Japanese Patent Publication No. 2879948). By this voice processing apparatus, the conversion of a tone pitch into that of harmony voice is done by detecting a tone pitch which is the closest to the input voice from among tone pitches of pitch names which form a chord of a melody range (higher than accompaniment range) to convert input voice into voice of the detected tone pitch (however, not the same pitch as that of the input voice).

In addition, there is a melody addition note control apparatus which generates an added note to add the added note to a melody note input by musical performance (see Japanese Unexamined Patent Publication No. 5-224677). By the melody addition note control apparatus, in a duet setting with a rhythm pattern of rock or 16-beat, a note which is a third below a melody note is determined as an added note. In a trio setting with a rhythm pattern of rock or 16-beat, notes which are a third and a sixth below a melody note are determined as added notes.

SUMMARY OF THE INVENTION

By the above-described conventional voice processing apparatus, however, although well-balanced harmony voice which is in harmony with input chord information can be obtained, it is necessary to input appropriate chord information.

By the above-described conventional melody addition note control apparatus, an added note (harmony note) which is a certain interval away from an input melody note (an input note) is determined. In this case, the tone pitch of the harmony note is determined by adding/subtracting the number of semitones corresponding to the interval (e.g., 7 semitones in a case of a fifth degree) to/from the tone pitch of the input note. However, the determined harmony note can fall outside the scale of the key of a musical piece in some cases. In such cases, the harmony note will go out of balance.

The present invention was accomplished to solve the above-described problems, and an object thereof is to provide an electronic musical apparatus which easily generates a well-balanced harmony note which is in harmony with an input note.

In order to achieve the above-described object, it is a feature of the present invention to provide an electronic musical apparatus including a first retrieval portion for retrieving tonality information; a second retrieval portion for retrieving degree information; a reception portion for receiving input note information; an extraction portion for extracting tone pitch information from the input note information received by the reception portion; a first determination portion for determining a scale on the basis of the tonality information retrieved by the first retrieval portion; a second determination portion for determining a reference scale note on the basis of the tone pitch information which is extracted from the input note information by the extraction portion, and the scale determined by the first determination portion; a third determination portion for determining a tone pitch of a harmony note by counting scale notes which form the determined scale from the reference scale note determined by the second determination portion until reaching a scale note designated by the degree information retrieved by the second retrieval portion; and a generation portion for generating the harmony note in accordance with the tone pitch of the harmony note determined by the third determination portion.

The electronic musical apparatus of the present invention enables generation of a scale note corresponding to the tonality of a musical piece as a harmony note. Therefore, the electronic musical apparatus is able to generate a harmony note which is harmonized with an input note and is well-balanced without oddness. Furthermore, this electronic musical apparatus does not require a user to input appropriate chords one after another in accordance with input notes. According to the present invention, more specifically, only by designating or supplying appropriate tonality information and degree information at each user's defined break point of the musical piece before or during musical performance of the musical piece, the user is able to easily obtain harmony notes which are rich in music.

It is another feature of the present invention that the electronic musical apparatus further includes a judgment portion for judging whether an interval indicated by the retrieved degree information represents a relationship of octave; and a fourth determination portion for determining a tone pitch of a harmony note by calculating, when it is judged by the judgment portion that the interval represents the relationship of octave, the number of octaves on the basis of the interval and shifting the tone pitch information extracted from the input note information by the calculated number of octaves, wherein the generation portion generates the harmony note in accordance with the tone pitch of the harmony note determined by the fourth determination portion when it is judged by the judgment portion that the interval represents the relationship of octave, whereas the generation portion generates the harmony note in accordance with the tone pitch of the harmony note determined by the third determination portion when the interval does not represents the relationship of octave.

In a case where an interval of an octave relationship such as eight degree is designated as the degree information, the electronic musical apparatus of the present invention generates a harmony note which is an octave (octaves) higher or lower than an input note, preventing the harmony note from sounding dull even in a case where the input note is not a scale note of the scale, to realize the harmony note which is well-harmonized with the input note.

It is a further feature of the present invention that the second determination portion determines a leading note of the scale as the reference scale note, when the determined scale is a minor scale with a tone pitch indicated by the tone pitch information extracted from the input note information being a major seventh or a minor seventh above a tonic of the scale.

As for the tonality of minor scales, the seventh note of the scales is different between the natural minor scale and the harmonic minor scale. Actually, however, there are many cases in which notes of both a major seventh and a minor seventh are included as scale notes in a musical piece. Therefore, the electronic musical apparatus of the present invention is designed to handle both the major seventh and the minor seventh of a scale as scale notes of an identical degree regardless of whether the tonality is the natural minor scale or the harmonic minor scale, realizing most favorable harmony notes. The electronic musical apparatus even eliminates the necessity for the user to understand the difference between the natural minor scale and the harmonic minor scale for inputting input notes. In other words, this electronic musical apparatus does not require the user to be well-versed in music.

Furthermore, the present invention can be implemented not only as an invention of an apparatus but also as inventions of a computer-readable computer program that causes a computer to implement, a storage medium storing the computer program, and a method.

BRIEF DESCRIPTION OF THE DRAWINGS

FIG. 2 indicates (*a*) a major scale, (*b*) a natural minor scale, and (*c*) a harmonic minor scale generated in a case where a "tonic" is "C";

DESCRIPTION OF THE PREFERRED EMBODIMENT

Figure 1:
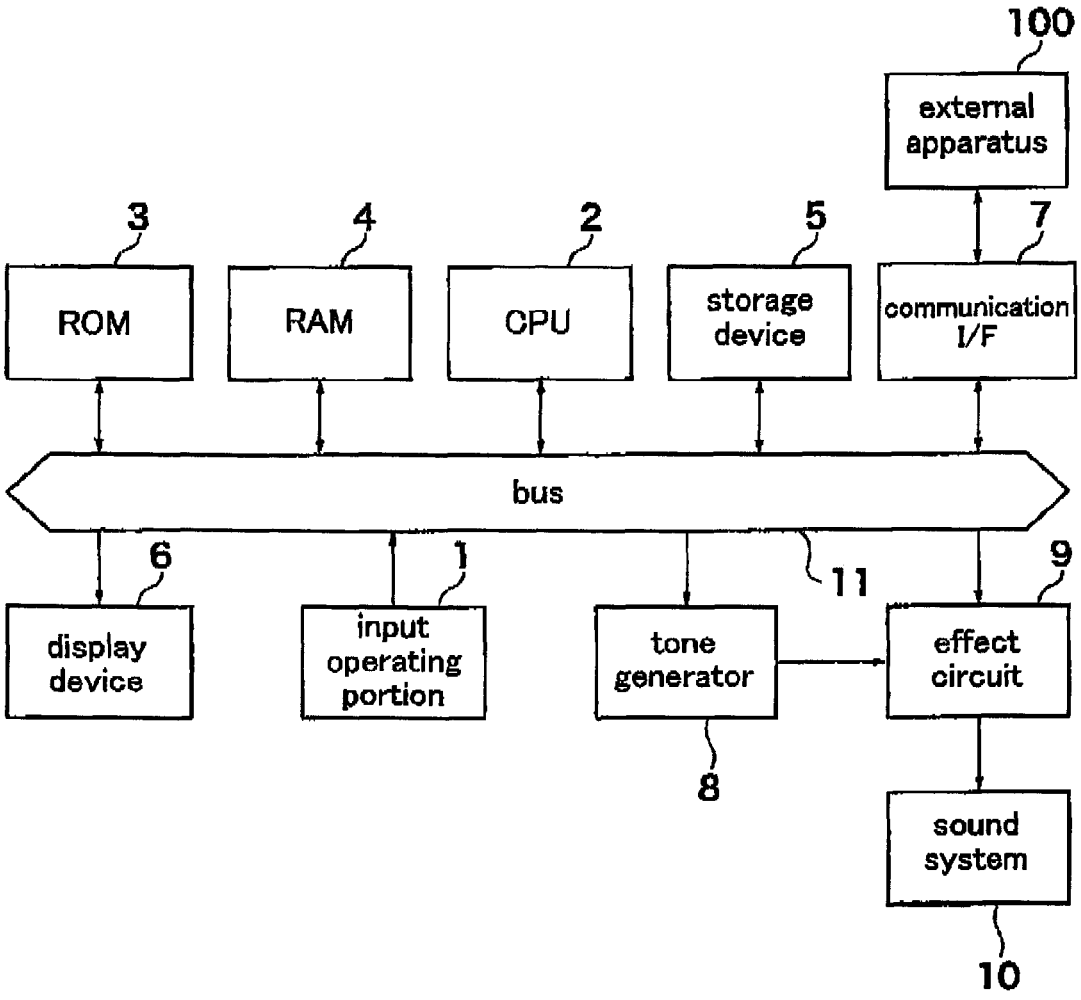
FIG. 1 is a block diagram indicative of a schematic configuration of an electronic musical apparatus according to an embodiment of the present invention.

An embodiment of the present invention will now be described with reference to the drawings. FIG. 1 is a block diagram indicative of a schematic configuration of an electronic musical apparatus according to the embodiment of the present invention.

As indicated in the figure, the electronic musical apparatus of the embodiment has an input operating portion 1, a CPU 2, a ROM 3, a RAM 4, storage device 5, a display device 6, a communication interface (I/F) 7, a tone generator 8, an effect circuit 9, and a sound system 10. The input operating portion 1 is formed of a microphone for inputting voice, performance operating elements such as a keyboard, and setting operating elements such as various kinds of switches. The CPU 2 controls the entire apparatus. The ROM 3 stores control programs which are to be executed by the CPU 2 and various kinds of tables and data. The RAM 4 temporarily stores performance information input by use of the performance operating elements, various kinds of input information, computed results, and the like. The storage device 5 stores various kinds of application programs including the above-described control programs, various kinds of musical piece data, various kinds of data and the like. The display device 6 has an LCD (liquid crystal display) and LEDs (light emitting diodes), for example, for displaying various kinds of information and the like. The communication interface (I/F) 7 allows connection with an external apparatus 100 such as an external MIDI (musical instrument digital interface) apparatus to allow transmission and reception of data between the electronic musical apparatus and the external apparatus 100. The tone generator 8 converts performance information input by use of the performance operating elements and performance information obtained by reproducing any of the musical piece data stored in the storage device 5 into musical tone signals. The effect circuit 9 adds various kinds of effects to the musical tone signals transmitted from the tone generator 8. The sound system 10 has a DAC (digital-to-analog converter), amplifiers and speakers, for example, which convert the musical tone signals transmitted from the effect circuit 9 into sounds.

The above-described components 9 to 9 are interconnected through a bus 11. To the communication interface 7, the external apparatus 100 is connected. To the tone generator 8, the effect circuit 9 is connected. To the effect circuit 9, the sound system 10 is connected.

The storage device 5 is storage media such as flexible disk (FD), hard disk (HD), CD-ROM, DVD (digital versatile disc), magneto-optical disk (MO) and semiconductor memory, and their respective drives. The storage media may be detachable from their respective drives. Alternatively, the storage device 5 itself may be detachable from the electronic musical apparatus of this embodiment. Furthermore, both the storage media and the storage device 5 may be undetachable. In the storage device 5 (In the storage media of the storage device 5), furthermore, the control programs which are to be executed by the CPU 2 can be stored as described above. In a case where the ROM 3 does not store the control programs, therefore, the control programs may be stored in the storage device 5 so that the control programs will be read into the RAM 4 to allow the CPU 2 to operate as in the case where the control programs are stored in the ROM 3. Such a configuration facilitates addition and update of the control programs.

To the communication I/F 7, the external apparatus 100 is connected in the shown example. However, a server computer may be connected to the communication I/F 7 through a communication network such as a LAN (local area network), the Internet or telephone line. In this case, if the above-described programs and various parameters are not stored in the storage device 5, the communication I/F 7 is used to download the programs and parameters from the server computer. More specifically, the electronic musical apparatus serving as a client transmits a command requesting downloading of the programs and parameters to the server computer through the communication I/F 7 and the communication network. In response to the command, the server computer distributes the requested programs and parameters to the electronic musical apparatus through the communication network. The electronic musical apparatus then receives the programs and parameters through the communication I/F 7 to store the received programs and parameters in the storage device 5 to complete the downloading.

The tone generator 8 not only converts performance information into musical tone signals as described above but also generates musical tone signals indicative of lead notes corresponding to input lead note data (digitized data of lead notes sung by a user) as described later. In addition, the tone generator 8 converts respective tone pitches of the lead note data into tone pitches of harmony notes to generate musical tone signals indicative of the lead notes of the converted tone pitches, that is, the musical tone signals indicative of the harmony notes.

As apparent from the above-described configuration, the electronic musical apparatus of the embodiment is provided on an electronic keyboard musical instrument. However, the electronic musical apparatus of the embodiment may be provided on a general-purpose personal computer to which a keyboard is externally connected. Furthermore, the present invention can be realized without a keyboard. Therefore, the electronic musical apparatus of the present invention can be various types such as a stringed instrument type, a wind instrument type and a percussion instrument. In addition, the present invention can be applied not only to an electronic musical instrument but also to various kinds of electronic apparatuses such as karaoke apparatus, game apparatus and communication apparatus.

The outline of control processing which the electronic musical apparatus configured as above executes will be described. Then, details of the control processing will be described, referring to FIG. 2 to FIG. 4.

Assume that tonality information and degree information for generating harmony notes are set in the electronic musical apparatus of the embodiment. The tonality information is used for generating a scale (for generating scale notes which form the scale). In this embodiment, more specifically, the tonality information is represented by a combination of information indicative of a "tonic" and information indicative of either "major key" or "minor key". Specifically speaking, the tonality information is represented by "C maj", "C min", for example. Furthermore, scales of minor keys, that is, "minor scales" include "natural minor scales" and "harmonic minor scales" (although minor scales also include "melodic minor scales", it is considered in this embodiment that the melodic minor scales are not included for convenience of explanation). Therefore, the tonality information on a "minor key" includes information indicating which scale the "minor scale" is, "natural minor scale" or "harmonic minor scale". The degree information, which is used for determining a harmony note, indicates the interval by which the harmony note is away from a scale note (reference scale note) included in the scale which is to be generated. More specifically, the degree information is represented by an integer having a sign (±). The sign "+" indicates that the harmony note is higher in pitch than the reference scale note, whereas the sign "−" indicates that the harmony note is lower in pitch. The manner in which the reference scale note is determined will be described later in the detailed explanation of the control processing.

First, the CPU 2 retrieves currently set tonality information to determine a "key" and a "tonic" on the basis of the retrieved tonality information to generate a scale on the basis of the determined "key" and "tonic". In a case where the "key" is major, more specifically, the CPU 2 generates a major scale of the determined "tonic". In a case where the "key" is minor, the CPU 2 further determines which is designated, "natural minor scale" or "harmonic minor scale". In a case where the "natural minor scale" is designated, the CPU 2 generates the "natural minor scale" of the determined "tonic". In a case where the "harmonic minor scale" is designated, the CPU 2 generates the "harmonic minor scale" of the determined "tonic".

FIG. 2 indicates (*a*) a major scale, (*b*) a natural minor scale, and (*c*) a harmonic minor scale generated in a case where the determined "tonic" is "C". In FIG. 2 (*a*) to (*c*), the scale (scale notes which form the scale) generated by the CPU 2 is a string of seven scale notes (pitch names) indicated in a row of "case of tonic "C"". In the case of the major scale of FIG. 2 (*a*), for example, the scale generated by the CPU 2 is a string of pitch names "C", "D", "E", "F", "G", "A", and "B". Although FIG. 2 also indicates other pieces of information, that is, names and values indicated in respective rows "interval", "scale note", "number of semitones (ascending)" and "number of semitones (descending)", these pieces of information are indicated for convenience in explanation, and are not the information generated by the CPU 2.

The determined tonic and the generated scale are temporarily stored in the RAM 4. Furthermore, the CPU 2 also determines a leading note of the scale in accordance with the generated scale. In addition, the CPU 2 retrieves the currently set degree information. The leading note and the degree information are also temporarily stored in the RAM 4.

When the user inputs the user's singing voice by use of the microphone included in the input operating portion 1, for example, the CPU 2 digitizes the input singing voice (analog voice signal) to store the digitized voice as lead note information (data) in a lead note data storage area (not shown) provided in the RAM 4. The CPU 2 detects the tone pitch of a lead note on the basis of the lead note data stored in the lead note data storage area by a known manner, and uses the detected tone pitch in order to generate a harmony note. Furthermore, the CPU 2 reads out the lead note data at certain timing to transmit the read data to the tone generator 8. The tone generator 8 then generates the lead note (a musical tone signal of the lead note) corresponding to the transmitted lead note data to output the generated musical tone signal to the effect circuit 9. The effect circuit 9 adds appropriate effects to the input musical tone signal to output the musical tone signal to an integrated signal output control circuit (not shown).

The CPU 2 then determines a reference scale note as follows:

(a1) In a case where the scale is minor with the lead note being a major seventh or a minor seventh above the tonic of the scale, the leading note of the scale is determined as the reference scale note;

(a2) In a case where the lead note is one of the scale notes of the scale, the pitch name of the scale note corresponding to the lead note is determined as the reference scale note; and (a3) In a case where the lead note is not a scale note of the scale, a pitch name of a scale note which is included in the scale, is one of the scale notes closest to the lead note and is lower in pitch than the lead note is determined as the reference scale note.

Defining the reference scale note as the first note, the CPU 2 counts the scale notes of the scale upward in the case of the retrieved degree information having the sign "+", and downward in the case of the retrieved degree information having the sign "−" until reaching a scale note designated by the degree information to obtain the pitch name of the reached scale note. In accordance with the obtained pitch name of the scale note, the lead note and the sign of the degree information, the CPU 2 calculates a tone pitch to detect as the tone pitch of a harmony note.

In addition, the CPU 2 requests the tone generator 8 to generate a harmony note having the calculated tone pitch (a musical tone signal of the harmony note). In response to this request, the tone generator 8 converts the detected tone pitch of the lead note data into the calculated tone pitch of the harmony note to generate the harmony note (a musical tone signal of the harmony note) to output the generated harmony note (the musical tone signal) to the effect circuit 9. The effect circuit 9 adds appropriate effects to the input musical tone signal to output to the signal output control circuit.

The signal output control circuit mixes the input two kinds of musical tone signals, and then outputs the mixed signals to the following sound system 10 at certain output timing.

When the user changes the pitch of the user's singing voice, the tone pitch of the reference scale note determined by the above-described determination processing also varies. As a result, a new harmony note (whose tone pitch has changed) is generated to be emitted as a musical note. When the degree information changes, furthermore, a new harmony note is generated similarly to be emitted as a musical note. When the tonality information changes, "key" and "tonic" are re-determined to determine a new reference scale note. In accordance with the determined reference scale note, a new harmony note is generated to be emitted as a musical note.

In this embodiment, as described above, scale notes corresponding to the tonality of the musical piece are generated as harmony notes. Therefore, this embodiment is able to obtain harmony notes which are harmonized with input notes and are well-balanced without oddness. Furthermore, this embodiment does not require the user to input appropriate chords one after another in accordance with input notes. According to this embodiment, more specifically, only by designating or supplying appropriate tonality information and degree information at each user's defined break point of the musical piece before or during musical performance of the musical piece, the user is able to easily obtain harmony notes which are rich in music.

As for the tonality of minor scales, the seventh (VII) note of the scales is different between the natural minor scale and the harmonic minor scale (see FIG. 2). Actually, however, there are many cases in which notes of both a major seventh and a minor seventh are included as scale notes in a musical piece. This embodiment is designed to handle both the major seventh and the minor seventh as scale notes of an identical degree regardless of whether the tonality is the natural minor scale or the harmonic minor scale, realizing most favorable harmony notes. The embodiment even eliminates the necessity for the user to understand the difference between the natural minor scale and the harmonic minor scale for inputting input notes. In other words, this embodiment does not require the user to be well-versed in music.

Figure 3A:
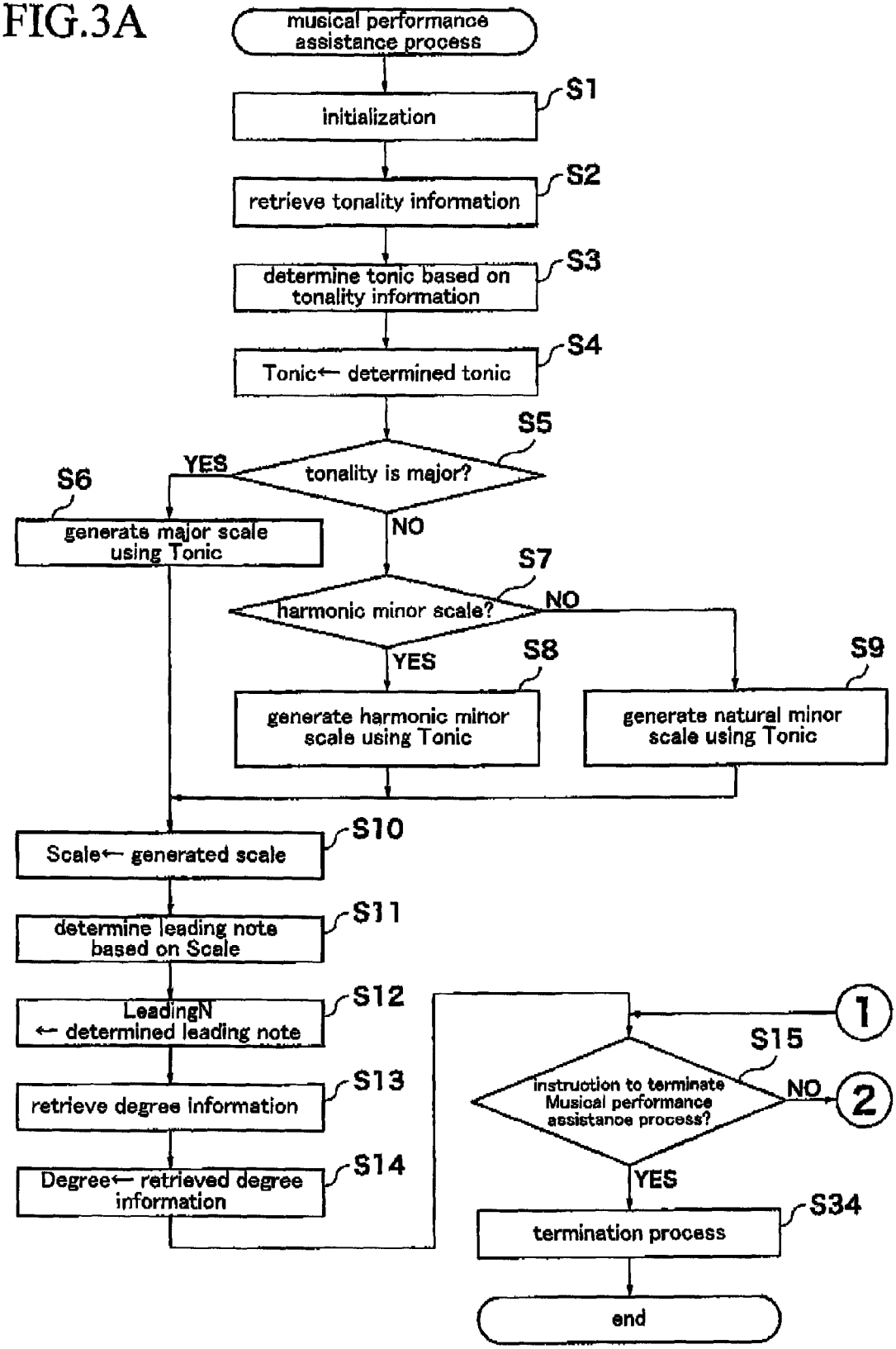
FIG. 3A is a flowchart indicative of procedures of a musical performance assistance process executed by the electronic musical apparatus indicated in FIG. 1, particularly, by a CPU.
Figure 3B:
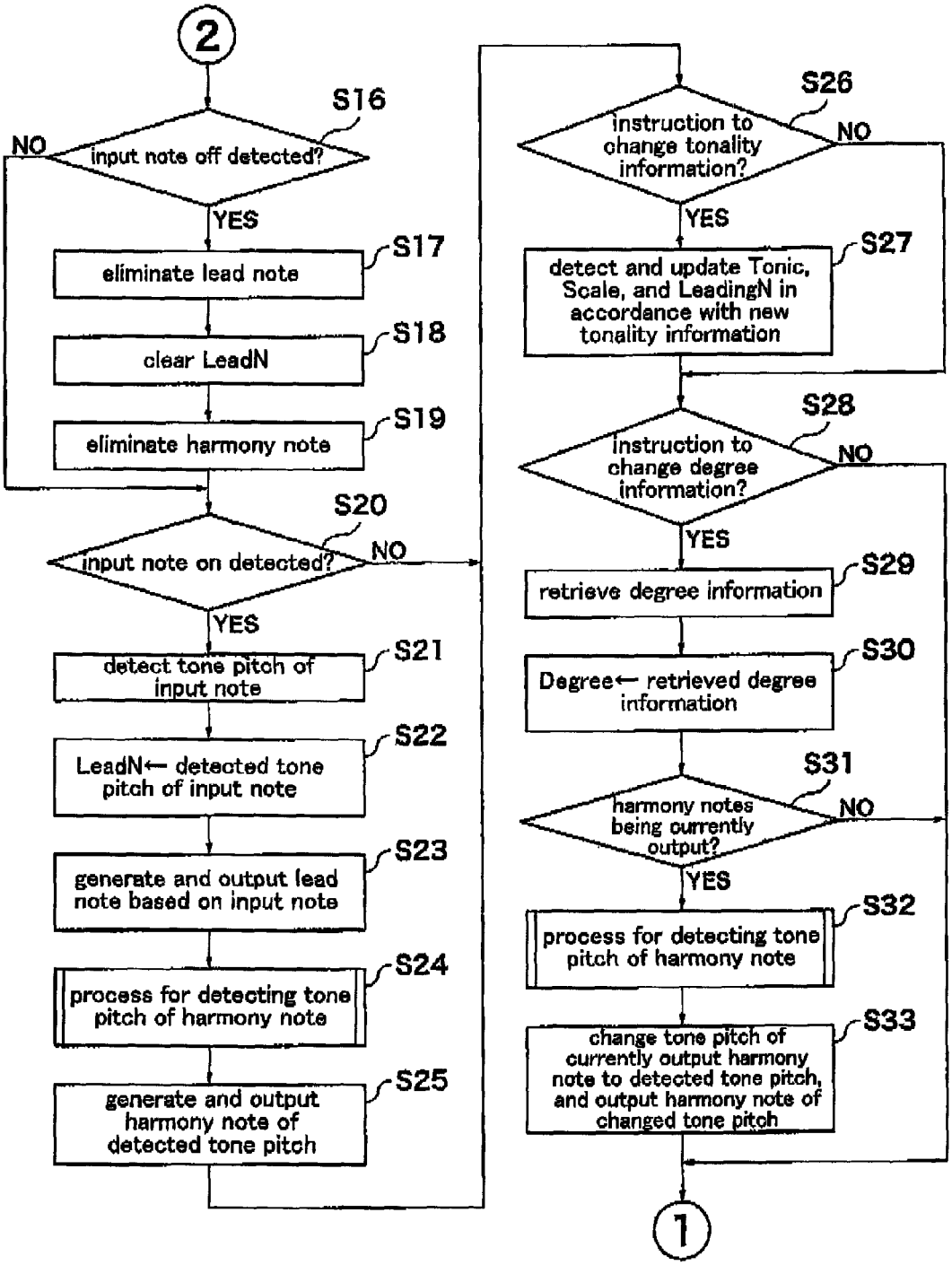
FIG. 3B is a flowchart indicative of continued procedures of the musical performance assistance process indicated in FIG. 3A.

Next, the control processing will be described in detail. FIG. 3A and FIG. 3B are flowcharts indicative of procedures of a musical performance assistance process which the electronic musical apparatus of the embodiment, particularly, the CPU 2 carries out.

The musical performance assistance process is mainly formed of:

(1) Start process (steps S1 to S14)
(2) Input note off detection process (steps S17 to S19)
(3) Input note on detection process (steps S21 to S25)
(4) Tonality information change process (step S27)
(5) Degree information change process (steps S29 to S33)
(6) Musical performance assistance termination process (step S34)

The musical performance assistance process starts when power of the electronic musical apparatus is turned on by a power switch (not shown) included in the input operating portion 1, for example. After the start, the above-described start process (1) is carried out once, followed by the respective processes (2) to (5) as needed. The respective processes (2) to (5) are repeatedly executed as needed until an instruction to terminate the musical performance assistance process is made, or until the power of the electronic musical apparatus is turned off by the power switch. In a case where the instruction to terminate the musical performance assistance process is made, the musical performance assistance process is terminated after the execution of the musical performance assistance termination process.

Once the musical performance assistance process starts, the CPU 2 proceeds to the start process (1). In the start process (1), the CPU 2 performs initialization (step S1). In the initialization, the CPU 2 clears the RAM 4, and establishes settings such as the tonality information, the degree information, tone color and tone volume. Although the RAM 4 has an area Tonic for storing a tonic determined on the basis of retrieved tonality information, an area Scale for storing a string of scale notes which form a scale generated on the basis of the tonic and the retrieved tonality information, an area LeadingN for storing a leading note determined on the basis of the generated string of scale notes, an area Degree for storing retrieved degree information, and an area LeadN for storing a tone pitch detected from an input note, the above-described clearing of the RAM 4 also involves clearing of these areas Tonic, Scale, LeadingN, Degree and LeadN. As for the settings of tonality information, degree information, tone color, tone volume and the like, the electronic musical apparatus may set respective default values or respective stored values which have been set at the previous musical performance assistance process.

The CPU 2 then retrieves the set tonality information (step S2) to determine a tonic on the basis of the retrieved tonality information (step S3). Because the tonality information is formed of the combination of information indicative of "tonic" and information indicative of "major key" or "minor key" in this embodiment as described above, the "tonic" can be easily determined on the basis of the retrieved tonality information. The CPU 2 then stores the determined tonic in the area Tonic. Hereafter, the tonic stored in the area Tonic will be referred to as "Tonic".

The CPU 2 then generates scale notes on the basis of the retrieved tonality information and the "Tonic" as follows:

(1a) In a case of the tonality of "major key": a major scale of the "Tonic" is generated (step S5→S6);

(1b) In a case of the tonality of "minor key" with "harmonic minor scale" being designated: a harmonic minor scale of the "Tonic" is generated (step S5→S7→S8); and (1c) In a case of the tonality of "minor key" with "natural minor scale" being designated: a natural minor scale of the "Tonic" is generated (step S5→S7→S9).

The CPU 2 then stores the generated scale in the area Scale (step S10). In a case where "C" is stored as "Tonic", therefore, the string of seven scale notes (pitch names) indicated in the row of "case of tonic C" of one of the three lists FIGS. 2(*a*) to (*c*) is to be stored in the area Scale. Hereafter, the scale stored in the area Scale will be referred to as "Scale". In a case where the Tonic is not "C", the Scale can be obtained by referring to the intervals of the list which is included in the lists of FIG. 2 and corresponds to the tonality information to obtain the "tonic", a note situated a major second above the "tonic", a note situated a major second above the note, and so on to determine the seven scale notes.

The CPU 2 then determines a "leading note" on the basis of the obtained Scale (step S11). Because a seventh (VII) scale note is the leading note in every scale as indicated in FIGS. 2 (*a*) to (*c*), the "leading note" can be uniquely determined once the Scale is determined. The CPU 2 then stores the determined "leading note" in the area LeadingN (step S12). Hereafter, the leading note stored in the area LeadingN will be referred to as "LeadingN".

The CPU 2 then retrieves the set degree information (step S13) to store the retrieved degree information in the area Degree (step S14). Hereafter, the degree information stored in the area Degree will be referred to as "Degree". The steps described above are the start process (1).

The CPU 2 then checks whether the user has instructed to terminate the musical performance assistance process (step S18). In a case where it is judged that the instruction to terminate the musical performance assistance process has been made, the CPU 2 proceeds to the musical performance assistance termination process (6). In a case where it is judged that the instruction to terminate the musical performance assistance process has not been made, the CPU 2 proceeds to step S16 of FIG. 3B. The musical performance assistance termination process (6) will be described in detail later.

In step S16, the CPU 2 checks whether input note off has been detected. In a case where the input note off has been detected, the CPU 2 proceeds to the input note off detection process (2). In a case where the input note off has not been detected, the CPU 2 proceeds to step S20. The input note is lead note data stored in the lead note data storage area, that is, voice sung by the user (digital data of the voice). The step S16 may be designed such that "lead note off" is detected when the level of the lead note data stored in the lead note data storage area is smaller than or equal to a certain threshold value (a value at which it is considered that any voice is not input), for example, whereas it is judged in step S16 that "lead note off" is not detected in other cases (that is, voice is still being input).

In the input note off detection process (2), the CPU 2 eliminates lead note (step S17) and clears the area LeadN (step S18), also eliminating harmony note (step S19). In this embodiment, the elimination of lead note and harmony note is accomplished by a request made to the tone generator 8 to eliminate the notes. When the input note off has been detected, the level of the lead note data is very low. Therefore, it can be questioned whether the lead note should be eliminated further. However, the lead note may be eliminated purposely. Of course, the lead note can be left as they are.

In the above-described step S20, the CPU 2 checks whether input note on has been detected. In a case where the CPU 2 detects the input note on, the CPU 2 proceeds to the input note on detection process (3). In a case where the CPU 2 does not detect the input note on, the CPU 2 proceeds to step S26. The step S20 may be designed such that the "input note" is judged as being on when an average level of a certain range of data which is included in the lead note data stored in the lead note data storage area and which the tone generator 8 is about to output is higher than a certain threshold value, for example. In other cases, it is judged in step S20 that the "input note" is not on.

In the input note on detection process (3), the CPU 2 detects the tone pitch of the input note (step S21). In this embodiment, as described above, because input notes are user's singing voice, the tone pitch of the input note has to be detected on the basis of the singing voice. Such detection of tone pitch can be done by a known method. In addition, the feature of the present invention does not lie on the detection of tone pitch of singing voice. Therefore, the detection of tone pitch in step S21 can be done by the known method.

The CPU 2 then stores the detected tone pitch of the input note in the area LeadN (step S22). Hereafter, the tone pitch of the input note stored in the area LeadN is referred to as "LeadN". As described in the outline of the control processing, the CPU 2 digitizes the input analog voice signal, stores the digitized signal as lead note data in the lead note data storage area in the RAM 4, and then reads out the lead note data at certain timing to transmit the read data to the tone generator 8 (step S23).

Furthermore, the CPU 2 carries out a process for detecting a tone pitch of a harmony note (step S24). As described in the outline of the control processing, the process for detecting a tone pitch of a harmony note is a process in which a reference scale note is determined in accordance with the Scale, the LeadN and the like, so that the tone pitch of a harmony note is detected in accordance with the determined reference scale note, the Degree and the LeadN. Detailed steps of the process will be described later, referring to FIG. 4. The CPU 2 then outputs tone pitch information on the detected tone pitch of the harmony note to the tone generator 8 (step S25). The tone generator 8 then converts the pitch of the lead note data to the tone pitch of the input tone pitch information to output lead note data whose tone pitch has been converted, that is, harmony note data to the effect circuit 9.

In the above-described step S26, the CPU 2 checks whether the user has instructed to change the tonality information. In a case where the user has instructed to change the tonality information, the CPU 2 proceeds to the tonality information change process (4). In a case where the user has not instructed to change the tonality information, the CPU 2 proceeds to step S28.

In the tonality information change process (4), the CPU 2 sets new tonality information selected by the instruction to change tonality information, determines or generates new "tonic", "scale" and "leading note" in accordance with the new tonality information, and updates the Tonic, the Scale and the LeadingN in accordance with the determined or generated information (step S27). More specifically, the CPU 2 carries out processes similar to the above-described steps S2 to S12.

In the above-described step S28, the CPU 2 checks whether the user has instructed to change the degree information. In a case where the user has instructed to change the degree information, the CPU 2 proceeds to the degree information change process (5). In a case where the user has not instructed to change the degree information, the CPU 2 returns to the above-described step S15 of FIG. 3A.

In the degree information change process (5), the CPU 2 retrieves new degree information selected by the instruction to change the degree information (step S29), and then replaces the Degree with the retrieved degree information (step S30). The CPU 2 then checks whether any harmony notes are currently being output (step S31). In this embodiment, as described in step S25, because the output of harmony notes is done by the tone generator 8, the CPU 2 conducts the check by inquiring of the tone generator 8 whether the tone generator 8 is outputting any harmony notes. The check can be done not only by directly inquiring of the tone generator 8 but also by indirectly checking whether the tone generator 8 is currently outputting any harmony notes, for example, by monitoring the level of a channel or port through which the tone generator 8 outputs the harmony notes if the CPU 2 can identify the channel or port. In other words, any scheme can be employed as long as the CPU 2 can check whether the tone generator 8 is currently outputting any harmony notes. In a case where it is judged that a harmony note is currently being output, the CPU 2 carries out the process for detecting the tone pitch of the harmony note as in the case of the above-described step S24 (step S32), and then outputs the detected tone pitch information about the harmony note to the tone generator 8 as in the case of the above-described step S25 (step S33). The tone generator 8 then converts the tone pitch of the lead note data into the tone pitch of the changed tone pitch information to output the lead note data having the converted tone pitch, that is, harmony note data having the tone pitch which is different from that of the currently output harmony note to the effect circuit 9.

In a case where the tone generator 8 is not outputting any harmony notes, the CPU 2 returns to the above-described step S15 without doing anything. If an instruction to terminate the musical performance assistance process is not made, the CPU 2 proceeds from step S15 to step S16. In a case where input note on is detected again, the CPU 2 proceeds from step S20 to step S21 to go through step S24 in which a tone pitch of a new harmony note is detected in accordance with the changed Degree, so that the harmony note having the tone pitch is generated to be output (step S25).

In the musical performance assistance termination process (6), the CPU 2 stores the currently set tonality information, degree information and the like in the storage device 5. By this process, the electronic musical apparatus is able to reproduce the previously selected state and previous settings when the musical performance assistance process is started next time.

Figure 4:
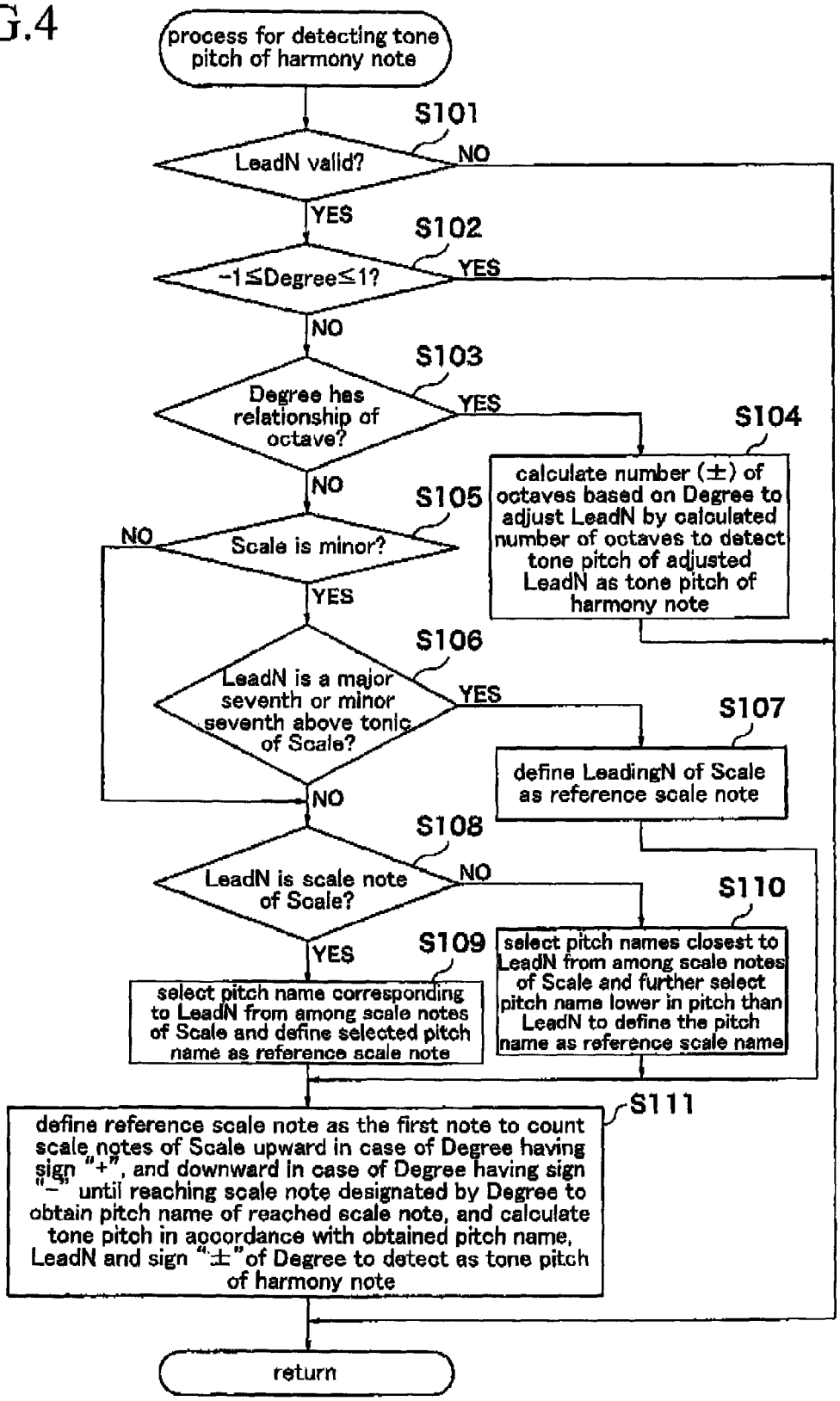
FIG. 4 is a flowchart indicative of detailed procedures of a process for detecting a tone pitch of a harmony note indicated in FIG. 3B.

FIG. 4 is a flowchart indicative of detailed procedures of the harmony note's tone pitch detection process carried out in the above-described step S24 and step S32. The harmony note's tone pitch detection process is formed mainly of:

(11) Octave number adjustment process (step S104)

(12) Reference scale note determination process (steps S105 to S110)

(13) Harmony note's tone pitch determination process (step S111).

Upon the start of the harmony note's tone pitch detection process, the CPU 2 checks whether the LeadN is valid, that is, whether the tone pitch of a significant lead note is detected (step S101). In a case it is judged that the lead note LeadN is not valid, the CPU 2 terminates the harmony note's tone pitch detection process. In a case where it is judged that the lead note LeadN is valid, the CPU 2 proceeds to the next step S102.

In step S102, the CPU 2 checks whether the Degree satisfies an inequality, $-1 \leqq \text{Degree} \leqq +1$. In a case where it is judged that the Degree satisfies $-1 \leqq \text{Degrees} \leqq +1$, the CPU 2 terminates the process for detecting a tone pitch of a harmony note. In a case where it is judged that the Degree is "Degree<−1" or "+1<Degree", the CPU 2 proceeds to the next step S103. The Degree being "±1" means that a harmony note having the same tone pitch as the tone pitch of the reference scale note (as described later, the tone pitch of a reference scale note is the tone pitch of the lead note LeadN or a tone pitch which is quite close to the tone pitch of the lead note LeadN) is to be detected, which cannot result in detection of an effective harmony note. Therefore, the process for detecting a tone pitch of a harmony note is designed not to detect the tone pitch of a harmony note in such case. In addition, the Degree will not take "0" in reality. Because the present invention is targeted for beginners who do not have particular knowledge about music, however, the electronic musical apparatus of this embodiment is designed such that "0" can be employed as the Degree. However, the electronic musical apparatus may be designed not to allow "0" as the Degree at the setting of the degree information. In this case, it is checked in step S102 whether the Degree satisfies an equality "Degree=±1?". Although this embodiment is designed such that the amount of degree corresponds to a value (that is, the value of the Degree), this embodiment may be modified to employ an expression "one degree=0 whereas one octave=7". In this modification, it is checked in step S102 whether "the Degree=0?". For figuring out the number of octaves (see step S104 which will be described later), the Degree is to be divided by "7".

This embodiment is designed such that even if any tone pitch of a harmony note has not been detected in the harmony note's tone pitch detection process, a new harmony note is to be generated and be output in the above-described step S25 or 633 of FIG. 30 which follow the harmony note's tone pitch detection process. However, such description is made merely for convenience of the figure. If the step S24 or S32 has not detected any tone pitch of a harmony note, any new harmony notes will not be generated in reality, resulting in no output in the following step S25 or S33.

In the step S103, the CPU 2 checks whether the Degree represents a relationship of octave. The "relationship of octave" means that a number which is one or more octaves higher or lower such as ±8 degree or ±16 degree has been designated. When it is judged that the Degree represents a relationship of octave, the CPU 2 proceeds to the octave number adjustment process (11). When it is judged that the Degree does not represents a relationship of octave, the CPU 2 proceeds to the reference scale note determination process (12).

In the octave number adjustment process (11), the CPU 2 divides the Degree by "8" to obtain the number of octaves with a sign (±) to adjust the lead note LeadN by the obtained number of octaves to detect the resultant tone pitch as the tone pitch of a harmony note (step S104). By this octave number adjustment process (11), in a case where "C maj" is set as the tonality information with "+8" being set as the degree information, for example, when an input note "C" is input, the tone pitch of "C+1" ("+1" represents a note higher by one octave) is to be detected as the tone pitch of a harmony note. When an input note "C♯" is input in the same settings, the tone pitch of "C♯+1" is to be detected as the tone pitch of a harmony note. A technical concept of the present invention lies in the detection and generation of a harmony note which is a scale note included in the Scale. When the technical concept is faithfully applied, inputting of the input note "C" results in the harmony note having the tone pitch of "C+1". However, the case of the input note "C♯" would result in a harmony note having the tone pitch of "C+1". In the latter case, however, the combination of the input note "C♯" and the harmony note "C+1" makes the musical notes dull, for the input note and the harmony note are to be generated at the same time. Therefore, this embodiment judges whether the value of the set degree information represents the relationship of octave. In a case where the set degree information represents the relationship of octave, therefore, a note having the relationship of octave rather than a scale note is to be employed to be detected as a harmony note. As a result, this embodiment is able to avoid dull musical notes.

In the reference scale note determination process (12), the CPU 2 determines a reference scale note by the processes (a1) to (a3) described in the above-described outline of the control processing. The process (a1) corresponds to step S107, the process (a2) corresponds to step S109, whereas the process (a3) corresponds to step S110.

The CPU 2 then proceeds to the harmony note's tone pitch determination process (13). In the harmony note's tone pitch determination process, defining the reference scale note as the first note, the CPU 2 counts the scale notes of the scale upward in the case of the retrieved degree information having the sign "+", and downward in the case of the retrieved degree information having the sign "−" until reaching a scale note designated by the degree information to obtain the pitch name of the reached scale note. In accordance with the obtained pitch name of the scale note, the lead note and the sign of the degree information, the CPU 2 calculates a tone pitch to detect as the tone pitch of a harmony note, (step S111).

In a case where "C maj" is set as the tonality information, for example, a string of pitch names "C", "D", "E", "F", "G", "A" and "B" (a major scale of the tonic "C") is to be stored as the Scale. In this state, when "+3" is selected as the degree information with an input note "C" being input, the lead note LeadN is "C". Because "C" is a scale note included in the scale, that is, the major scale of the tonic "C", the reference scale note is to be defined as "C". A scale note which is a third above (Degree=+3) the reference scale note "C" is "E". Therefore, the pitch name of the harmony note is determined as "E". When an input note "D" is input in the similar settings, the pitch name of the harmony note is determined as "F" by the similar processing. In a case, however, where the technical concept of the present invention is not applied, when an input note "C" is input, the Degree=+3 results in the detection of a tone pitch which is four semitones higher than the lead note LeadN. More specifically, the pitch name "E" is to be detected as a harmony note. In this case, that is, the pitch name which is the same one as the case where the technical concept of the present invention is applied is detected as a harmony note. In a case, however, where an input tone "D" is input, a harmony note to be detected is a pitch name "F♯" which is different from the one detected when the technical concept of the present invention is applied. That is, the harmony note which is to be detected is not included in the scale notes of the scale. Without the technical concept of the present invention, as described above, there are cases in which a harmony note which is not a scale note of the scale is, detected depending on the input note.

In a case "C min" is set as the tonality information with "harmonic minor scale" being designated, a string of pitch names "C", "D", "E♭", "F", "G", "A♭" and "B" (a harmonic minor scale of tonic "C") is to be stored as the Scale. In this state, when "+3" is selected as the degree information with an input note "B♭" being input, the lead note LeadN is "B♭". Because "B♭" is a minor seventh above the tonic "C" of the scale, that is, the harmonic minor scale, the reference scale note is to be determined as the leading note LeadingN of the scale. More specifically, the reference scale note is "B". A scale note which is a third above (Degree=+3) the reference scale note "B" is "D". Therefore, the pitch name of the harmony note is determined as "D". If such an exceptional process, that is, the above-described step S107 is not employed, because the lead note LeadN "B♭" is not included in the scale notes of the harmonic minor scale of the tonic "C", the step S110 would result in the reference scale note "A♭". As a result, the pitch name of the harmony note for the LeadN "B♭" would be determined as "C". In this setting of the harmonic minor scale, therefore, when a scale progression of the natural minor scale "A♭"→"B♭"→"C♭" is input as input notes, harmony notes which are a third above the input notes would be "C"→"C"→"E♭", respectively, which are not most favorable. Therefore, assuming that the input note "B♭" is the same scale note as "B" as an exception, a scale note which is two notes higher than "B♭" ("B") is "D". By the exceptional process, as a result, the input notes "A♭"→"B♭"→"C" result in harmony notes "C"→"D"→"E♭" which are a third (+3) above the input notes, respectively, which is the most favorable three-degree scale progression. In a case as well where a scale progression of the harmonic minor scale is input in spite of the setting of the natural minor scale, most favorable harmony notes can be generated similarly by this scheme.

In the above-described concrete example, the pitch name of a harmony note is detected on the basis of an input note. In the harmony note's tone pitch determination process (13), however, the tone pitch of a harmony note which is to be emitted is ultimately determined on the basis of the detected pitch name. The above-described process "the tone pitch of a harmony note which is to be emitted is determined on the basis of the detected pitch name" corresponds to the process of the above-described step S111 "In accordance with the obtained pitch name of the scale note, the lead note and the sign of the degree information, the CPU 2 calculates a tone pitch". When the sign of the Degree is "+", more specifically, a tone pitch which is included in tone pitches having the detected pitch name, is higher than the lead note LeadN, and is the closest to the lead note LeadN is figured out to be defined as the tone pitch of the harmony note. When the sign of the Degree is "−", on the other hand, a tone pitch which is included in tone pitches having the detected pitch name, is lower than the lead note LeadN, and is the closest to the lead note LeadN is figured out to be defined as the tone pitch of the harmony note.

In the above-described concrete example, by processing of steps 108 and 110 of FIG. 4, when a lead note is not any of the scale, a pitch name of a scale note which is included in the scale, is one of the scale notes closest to the lead note and is lower in pitch than the lead note is determined as a reference scale note. However, when a lead note is not any of the scale, a pitch name of a scale note which is included in the scale, is one of the scale notes closest to the lead note and is higher in pitch than the lead note might be determined as the reference scale note. Further, when a lead note is not any of the scale, either one of the lower and higher notes might be determined as the reference scale note according to the tone pitch change of the lead tone. Concretely, when a lead note is not any of the scale and changes higher in pitch, a pitch name of a scale note which is included in the scale, is one of the scale notes closest to the lead note and is lower in pitch than the lead note might be determined as the reference scale note, and when a lead note is not any of the scale and changes lower in pitch, a pitch name of a scale note which is included in the scale, is one of the scale notes closest to the lead note and is higher in pitch than the lead note might be determined as the reference scale note. In other words, the scale tone, which is opposite side of the change of the input tone, is determined as the reference scale note. Therefore, natural harmony notes are produced.

In the above-described concrete example, by processing of steps 106 and 107 of FIG. 4, when a lead note is a major seventh or a minor seventh above a tonic of the scale, a leading note of the scale is determined as a reference scale note. However, independently of the scale, when a lead note is a major third or a minor third above a tonic of the scale, a third note of the scale might be also determined as the reference scale note. Therefore, natural harmony notes are also produced.

In this embodiment, as described above, "minor scales" do not include "melodic minor scale". However, "melodic minor scale" may be also included in "minor scales". In this expanded case where "melodic minor scale" can be also selectable, as in the case where the "natural minor scale" or the "harmonic minor scale" is designated, a "melodic minor scale" of a determined "tonic" is generated to generate and emit an expected harmony note by the subsequent processes.

The tonality information may be input by use of operating elements such as switches or may be previously stored so that the previously stored tonality information will be read out. Alternatively, the electronic musical apparatus of the embodiment may accept tonality information which is newly supplied during the performance of a musical piece. In a case where a previously stored musical piece is read out to generate harmony notes on the basis of the read musical piece, furthermore, if any tonality information is not stored, a key automatically detected from song data of the musical piece by a known method may be used as the tonality information.

Although this embodiment is the example in which a harmony note is generated concurrently with a lead note, the present invention is not limited to this example but may be applied to other cases such as a case in which an accompaniment note is automatically generated, with a harmony note and a lead note being generated concurrently with the accompaniment note, and a case in which an accompaniment note is generated concurrently with a harmony note without a lead note.

Although this embodiment is designed such that the lead notes are generated on the basis of user's voice, this embodiment may be modified to generate the lead notes on the basis of performance information input by use of the performance operating elements. In this embodiment, furthermore, user's voice is input by use of the microphone. However, user's voice may be previously recorded so that the recorded user's voice will be reproduced to be used on the electronic musical apparatus. Similarly, performance information may be previously recorded so that the recorded performance information will be reproduced to be used on the electronic musical apparatus. In a case where the tonality information is not designated, the previously recorded voice or performance information may be used to determine a scale by a known method so that the determined scale can be used as the tonality information. Alternatively, the electronic musical apparatus may have a default scale.

The electronic musical apparatus of this embodiment may be designed such that the degree information is input by use of operating elements such as switches, or such that the degree information stored in some way to correspond to each musical piece is read out to be used in addition, the electronic musical apparatus may be also designed such that new degree information is supplied at some midpoint of a musical piece. Although the degree information is supplied as a numeric value (an integer) in this embodiment, the degree information may be supplied, for example, by user's concurrent depressions of two notes or consecutive depressions of two notes on the keyboard to indicate the interval of the two notes (from the lower note to the higher note/from the higher note to the lower note/from the first note to the second note).

Needless to say, the object of the present invention can be achieved by supplying a storage medium which stores program codes of software which realizes the functions of the above-described embodiment to a system or an apparatus so that a computer (or a CPU or an MPU) of the system or the apparatus can read out the program codes stored in the storage medium to execute the program codes.

In this case, the program codes themselves read out from the storage medium are to realize the new functions of the present invention. Therefore, the program codes and the storage medium in which the program codes are stored constitute the present invention.

As the storage medium for supplying the program codes, a flexible disk, a hard disk, a magneto-optical disk, a CD-ROM, a CD-R, a CD-RW, a DVD-ROM, a DVD-RAM, a DVD-RW, DVD+RW, a magnetic tape, a nonvolatile memory card, a ROM or the like can be used. The program codes may be also supplied from a server computer via a communication network.

Needless to say, furthermore, the above-described case includes a case where the execution of the program codes read out by the computer not only realizes the functions of the above-described embodiment but also allows an OS and the like which operates on the computer to conduct part of or all of actual processing in accordance with instructions made by the program codes to realize the functions of the above-described embodiment by the processing.

Needless to say, furthermore, the above-described case includes a case where the program codes read out from the storage medium are written into a function-expansion board inserted into the computer or a memory provided on a function-expansion unit connected to the computer, so that a CPU or the like of the function-expansion board or the function-expansion unit conducts part of or all of actual processing in accordance with instructions made by the program codes to realize the functions of the above-described embodiment by the processing.

What is claimed is:

1. An electronic musical apparatus comprising:

a first retrieval portion for retrieving tonality information;

a second retrieval portion for retrieving degree information;

a reception portion for receiving input note information;

an extraction portion for extracting tone pitch information from the input note information received by the reception portion;

a first determination portion for determining a scale on the basis of the tonality information retrieved by the first retrieval portion;

a second determination portion for determining a reference scale note on the basis of the tone pitch information which is extracted from the input note information by the extraction portion, and the scale determined by the first determination portion;

a third determination portion for determining a tone pitch of a harmony note by counting scale notes which form the determined scale from the reference scale note determined by the second determination portion until reaching a scale note designated by the degree information retrieved by the second retrieval portion; and a generation portion for generating the harmony note in accordance with the tone pitch of the harmony note determined by the third determination portion.

2. The electronic musical apparatus according to claim 1 further comprising:

a judgment portion for judging whether an interval indicated by the retrieved degree information represents a relationship of octave; and a fourth determination portion for determining a tone pitch of a harmony note by calculating, when it is judged by the judgment portion that the interval represents the relationship of octave, the number of octaves on the basis of the interval and shifting the tone pitch information extracted from the input note information by the calculated number of octaves, wherein the generation portion generates the harmony note in accordance with the tone pitch of the harmony note determined by the fourth determination portion when it is judged by the judgment portion that the interval represents the relationship of octave, whereas the generation portion generates the harmony note in accordance with the tone pitch of the harmony note determined by the third determination portion when the interval does not represent the relationship of octave.

3. The electronic musical apparatus according to claim 1, wherein the second determination portion determines a leading note of the scale as the reference scale note, when the determined scale is a minor scale with a tone pitch indicated by the tone pitch information extracted from the input note information being a major seventh or a minor seventh above a tonic of the scale.

4. The electronic musical apparatus according to claim 1, wherein the second determination portion determines the note indicated by the tone pitch information extracted from the input note information as the reference scale note, when the note indicated by the tone pitch information extracted from the input note information is one of the scale notes.

5. The electronic musical apparatus according to claim 1, wherein the second determination portion determines the note which is the closest to the note indicated by the tone pitch information extracted from the input note information and is lower in pitch than the note indicated by the tone pitch information extracted from the input note information as the reference scale note, when the note by the tone pitch information extracted from the input note information is not any scale notes of the scale notes.

6. The electronic musical apparatus according to claim 1, wherein the second determination portion determines the note which is the closest to the note indicated by the tone pitch information extracted from the input note information and is higher in pitch than the note indicated by the tone pitch information extracted from the input note information as the reference scale note, when the note by the tone pitch information extracted from the input note information is not any scale notes of the scale notes.

7. The electronic musical apparatus according to claim 1, wherein the second determination portion determines the note which is the closest to the note indicated by the tone pitch information extracted from the input note information and is lower in pitch than the note indicated by the tone pitch information extracted from the input note information as the reference scale note, when the note by the tone pitch information extracted from the input note information is not any scale notes of the scale notes and changes higher in pitch, and the second determination portion determines the note which is the closest to the note indicated by the tone pitch information extracted from the input note information and is higher in pitch than the note indicated by the tone pitch information extracted from the input note information as the reference scale note, when the note by the tone pitch information extracted from the input note information is not any scale notes of the scale notes and changes lower in pitch.

8. The electronic musical apparatus according to claim 1, wherein the input note information by received by the reception portion is a voice signal input by a microphone.

9. The electronic musical apparatus according to claim 8, wherein the generation portion generates the harmony note by converting the tone pitch of the voice signal into the determined tone pitch of the harmony note.

10. The electronic musical apparatus according to claim 1, wherein the input note information by received by the reception portion is generated on the basis of performance information input by use of performance operating elements.

11. The electronic musical apparatus according to claim 1 further comprising:

a prohibiting portion for prohibiting the generation portion from generating the harmony note, when an interval indicated by the retrieved degree information is more than or equal to −1 and less than or equal to +1.

12. A computer-readable medium storing program that causes a computer to implement steps, the program comprising:

a first retrieval step for retrieving tonality information;

a second retrieval step for retrieving degree information;

a reception step for receiving input note information;

an extraction step for extracting tone pitch information from the input note information received by the reception step;

a first determination step for determining a scale on the basis of the tonality information retrieved by the first retrieval step;

a second determination step for determining a reference scale note on the basis of the tone pitch information which is extracted from the input note information by the extraction step, and the scale determined by the first determination step;

a third determination step for determining a tone pitch of a harmony note by counting scale notes which form the determined scale from the reference scale note determined by the second determination step until reaching a scale note designated by the degree information retrieved by the second retrieval step; and a generation step for generating the harmony note in accordance with the tone pitch of the harmony note determined by the third determination step.

13. The computer-readable medium according to claim 12, wherein the program further comprising:

a judgment step for judging whether an interval indicated by the retrieved degree information represents a relationship of octave; and a fourth determination step for determining a tone pitch of a harmony note by calculating, when it is judged by the judgment step that the interval represents the relationship of octave, the number of octaves on the basis of the interval and shifting the tone pitch information extracted from the input note information by the calculated number of octaves, wherein the generation step generates the harmony note in accordance with the tone pitch of the harmony note determined by the fourth determination step when it is judged by the judgment step that the interval represents the relationship of octave, whereas the generation step generates the harmony note in accordance with the tone pitch of the harmony note determined by the third determination step when the interval does not represent the relationship of octave.

14. The computer-readable medium according to claim 12, wherein the second determination step determines a leading note of the scale as the reference scale note, when the determined scale is a minor scale with a tone pitch indicated by the tone pitch information extracted from the input note information being a major seventh or a minor seventh above a tonic of the scale.

15. The computer-readable medium according to claim 12, wherein the second determination step determines the note indicated by the tone pitch information extracted from the input note information as the reference scale note, when the note indicated by the tone pitch information extracted from the input note information is one of the scale notes.

16. The computer-readable medium according to claim 12, wherein the second determination step determines the note which is the closest to the note indicated by the tone pitch information extracted from the input note information and is lower in pitch than the note indicated by the tone pitch information extracted from the input note information as the reference scale note, when the note by the tone pitch information extracted from the input note information is not any scale notes of the scale notes.

17. The computer-readable medium according to claim 12, wherein the second determination step determines the note which is the closest to the note indicated by the tone pitch information extracted from the input note information and is higher in pitch than the note indicated by the tone pitch information extracted from the input note information as the reference scale note, when the note by the tone pitch information extracted from the input note information is not any scale notes of the scale notes.

18. The computer-readable medium according to claim 12, wherein the second determination step determines the note which is the closest to the note indicated by the tone pitch information extracted from the input note information and is lower in pitch than the note indicated by the tone pitch information extracted from the input note information as the reference scale note, when the note by the tone pitch information extracted from the input note information is not any scale notes of the scale notes and changes higher in pitch, and the second determination step determines the note which is the closest to the note indicated by the tone pitch information extracted from the input note information and is higher in pitch than the note indicated by the tone pitch information extracted from the input note information as the reference scale note, when the note by the tone pitch information extracted from the input note information is not any scale notes of the scale notes and changes lower in pitch.

19. The computer-readable medium according to claim 12, wherein the input note information by received by the reception step is a voice signal input by a microphone.

20. The computer-readable medium according to claim 19, wherein the generation step generates the harmony note by converting the tone pitch of the voice signal into the determined tone pitch of the harmony note.

21. The computer-readable medium according to claim 12, wherein the input note information by received by the reception step is generated on the basis of performance information input by use of performance operating elements.

22. The computer-readable medium according to claim 12, wherein the program further comprising:

a prohibiting step for prohibiting the generation step from generating the harmony note, when an interval indicated by the retrieved degree information is more than or equal to −1 and less than or equal to +1.

* * * * *